US006223726B1

(12) United States Patent
Jung et al.

(10) Patent No.: US 6,223,726 B1
(45) Date of Patent: May 1, 2001

(54) HIGH PRESSURE FUEL RESERVOIR

(75) Inventors: Steffen Jung, Leonberg; Manfred Bacher-Hoechst, Stuttgart, both of (DE); Heinz Popp, Roitham; Alois Mair, Leonding, both of (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/077,016

(22) PCT Filed: Jun. 12, 1997

(86) PCT No.: PCT/DE97/01188

§ 371 Date: May 18, 1998

§ 102(e) Date: May 18, 1998

(87) PCT Pub. No.: WO98/14700

PCT Pub. Date: Apr. 9, 1998

(30) Foreign Application Priority Data

Jun. 30, 1996 (DE) ..... 196 40 480

(51) Int. Cl.[7] ..... F02M 37/04
(52) U.S. Cl. ..... 123/468; 123/456
(58) Field of Search ..... 123/468, 469, 123/470, 456

(56) References Cited

U.S. PATENT DOCUMENTS

| | | | | |
|---|---|---|---|---|
| 4,475,516 | * | 10/1984 | Atkins | 123/470 |
| 4,899,712 | * | 2/1990 | DeBruyn | 123/469 |
| 4,979,295 | * | 12/1990 | Stagni | 123/470 |
| 5,033,435 | * | 7/1991 | Ostarello | 123/470 |
| 5,143,039 | * | 9/1992 | Gmelin | 123/470 |
| 5,176,121 | * | 1/1993 | Kennedy | 123/470 |
| 5,197,435 | * | 3/1993 | Mazur | 123/468 |
| 5,209,204 | * | 5/1993 | Bodenhausen | 123/470 |
| 5,295,467 | * | 3/1994 | Hafner | 123/468 |
| 5,408,971 | * | 4/1995 | Jaeger | 123/469 |

* cited by examiner

*Primary Examiner*—Carl S. Miller
(74) *Attorney, Agent, or Firm*—Ronald E. Greigg; Edwin E. Greigg

(57) ABSTRACT

A high-pressure fuel reservoir for a fuel injection system for internal combustion engines, which is supplied with high-pressure fuel by a high-pressure fuel pump and which has connections embodied as connection stubs, from each of the connection stubs one connecting bore discharges into the tubular body eccentrically to the axis of the tubular body. The tubular body is produced by forging, with three connecting stubs and fastening elements formed on by forging.

10 Claims, 1 Drawing Sheet

HIGH PRESSURE FUEL RESERVOIR

Prior Art

The invention is based on a high-pressure fuel reservoir for a vehicle. One such high-pressure fuel reservoir, known from European Patent Disclosure EP 0 507 191, comprises a prefabricated tube onto which connection cuffs are slipped to connect the fuel injection valves, or the high-pressure line arriving from the high-pressure fuel pump. Such a high-pressure fuel reservoir is relatively expensive to produce and moreover, because of the connection parts that have to mounted on it, requires a relatively large amount of installation space. In addition, it must have very thick walls in order to withstand the high pressures under the cyclic loads to which it is exposed. One disadvantage here is that thick-walled bodies subjected to major cyclic pressure loads tend to rip apart, especially in the area of openings in the walls and where there are sharp-edged changes in cross section.

ADVANTAGES OF THE INVENTION

By means of the high-pressure fuel reservoir of the invention, a high-pressure fuel reservoir is obtained that because of the eccentric location of the connecting bores is especially capable of withstanding the cyclic loads. Because of this eccentric location, the individual loads, in the region of a intersection with the inner wall of the high-pressure reservoir, are superimposed on one another only vectorially, resulting in an approximately 30% reduction in the loads. This substantially increases the strength and thus prolongs the service life of the high-pressure reservoir.

An advantageous feature is that the connecting bores discharge at a tangent to the inner wall of the tubular body. This further reinforces the aforementioned effect. To avoid abrupt cross-sectional transitions and thus to further reduce the partial heavy load on wall cross sections, an embodiment set forth herein is especially advantageous, in which the tubular body is shaped by forging, with connection stubs likewise formed by forging. This has the further advantage of requiring less installation shape, since the connections, because they are integral with the tubular body, can be made substantially smaller. In addition, the high-pressure reservoir is thus lower in weight.

DESCRIPTION OF THE EXEMPLARY EMBODIMENTS

Figure 1:
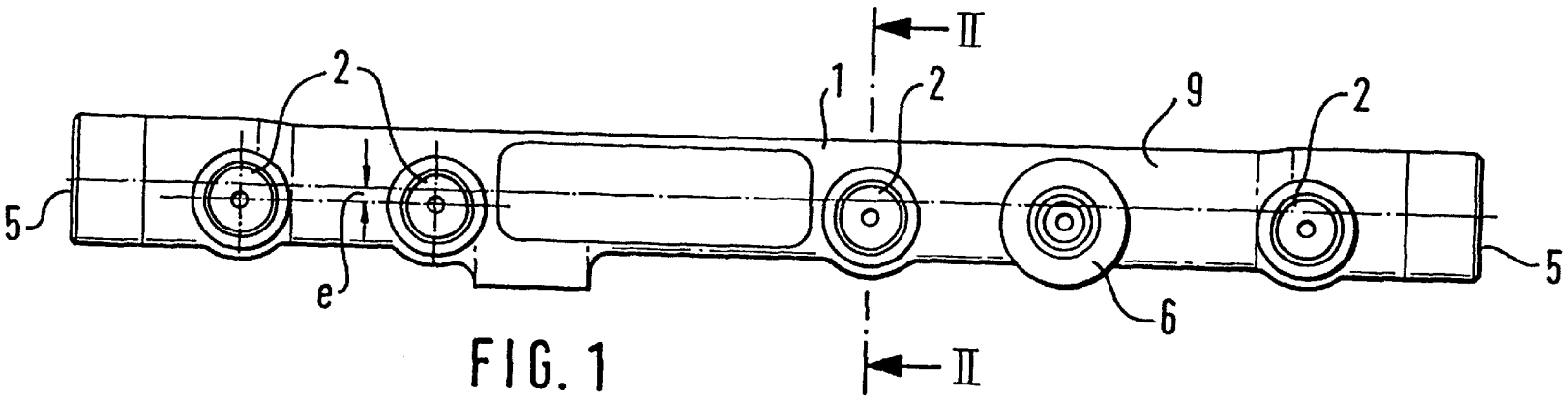
FIG. 1 is a side view of a high pressure fuel reservoir.
Figure 2:
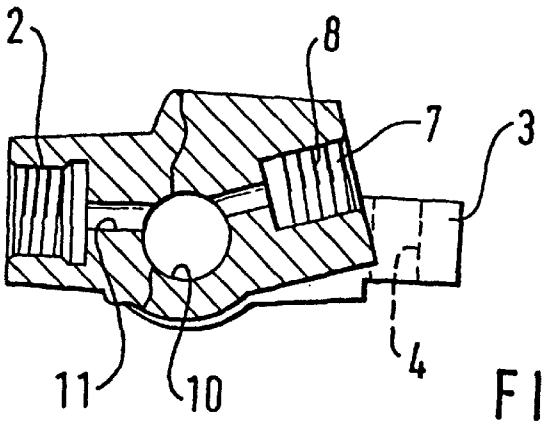
FIG. 2 is a cross-sectional view along lines II—II of FIG. 1.

In FIG. 1 of the drawing, a high-pressure fuel reservoir is shown, which comprises an elongated, forged tubular body 1, which on its jacket face has connecting stubs 2, formed by forging, for supplying four fuel injection valves, and which has fastening elements 3 formed onto the jacket face diametrically opposite the connecting stubs 2. The fastening elements take the form of fastening eyelets or tabs, with through holes 4 to be made by drilling, as can be seen from the section II—II in FIG. 2. On its face ends 5, an axial through recess 10 (FIG. 2) forming the interior of the high-pressure reservoir and embodied here as a through bore is firmly closed. An inlet from a high-pressure fuel pump, not shown here, to the interior of the high-pressure reservoir is formed by an additional connecting stub 6 located between two fuel injection valves connections. On the side of the fastening elements 3, the tubular high-pressure reservoir can have still another connecting stub 7, into which a pressure sensor or a control valve, for instance, can be screwed. The connecting stubs 2 are provided with a screw thread 8 in the usual way, into which high-pressure connecting lines can be inserted tightly, for instance via a cone seal. These lines communicate with the interior of the tubular high-pressure reservoir 1, that is, the through bore 10, via connecting bores 11. The cross section of this recess is preferably a circular area but it may also have some other shape, such as oval. The special feature of the invention in this respect is that the connecting bores discharge into the through bore 10 eccentrically to the longitudinal axis of the through bore, with an eccentricity e. The discharge is preferably effected tangentially. This affords the advantage, mentioned at the outset, that the tension load on the wall of the high-pressure reservoir in the region of intersection of the connecting bores with the longitudinal bore is reduced because in this construction the individual loads are superimposed only vectorially on one another. The connections 2 are used to connect the high-pressure fuel reservoir to electrically controlled fuel injection valves.

The foregoing relates to preferred exemplary embodiments of the invention, it being understood that other variants and embodiments thereof are possible within the spirit and scope of The invention, the latter being defined by the appended claims.

What is claimed is:

1. A high-pressure fuel reservoir for a fuel injection system for internal combustion engines, having a high-pressure fuel pump that supplies fuel to the high-pressure fuel reservoir, from which the fuel is delivered to electrically controlled injection valves for injection into the combustion chambers of a self-igniting internal combustion engine, the high-pressure fuel reservoir comprises an elongated strong metal tubular body that is provided with three different high pressure connections (2, 6, 7) for fuel delivery and fuel outflow, the connections are embodied as connection stubs, from each of said connections one connecting bore discharges into the tubular body eccentrically to a linear axis of the tubular body.

2. A high-pressure fuel reservoir of claim 1, in which the connecting bores discharge at a tangent to an inner wall of the tubular body.

3. A high-pressure fuel reservoir of claim 2, in which the internal cross section of the tubular body is a circular area.

4. A high-pressure fuel reservoir of claim 1, in which the tubular body is shaped by forging, with separate connection stubs (2, 6, 7) likewise formed on by forging.

5. A high-pressure fuel reservoir of claim 2, in which, the tubular body is shaped by forging, with separate connection stubs (2, 6, 7) likewise formed on by forging.

6. A high-pressure fuel reservoir of claim 3, in which, the tubular body is shaped by forging, with separate connection stubs (2, 6, 7) likewise formed on by forging.

7. A high-pressure fuel reservoir of claim 1, in which fastening tabs are formed onto the tubular body.

8. A high-pressure fuel reservoir of claim 2, in which fastening tabs are formed onto the tubular body.

9. A high-pressure fuel reservoir of claim 3, in which fastening tabs are formed onto the tubular body.

10. A high-pressure fuel reservoir of claim 4, in which fastening tabs are formed onto the tubular body.

* * * * *

UNITED STATES PATENT AND TRADEMARK OFFICE

CERTIFICATE OF CORRECTION

PATENT NO. : 6,223,726 B1
DATED : May 1, 2001
INVENTOR(S) : Steffen Jung et al.

It is certified that error appears in the above-identified patent and that said Letters Patent is hereby corrected as shown below:

Title page,
Foreign Application Priority Data, should read as follows:

-- [30] September 30, 1996 (DE) ..... 1 96 40 480 --

Signed and Sealed this

Fifth Day of February, 2002

*Attest:*

*Attesting Officer*

JAMES E. ROGAN
*Director of the United States Patent and Trademark Office*